US006628091B2

(12) United States Patent
Griffin et al.

(10) Patent No.: US 6,628,091 B2
(45) Date of Patent: Sep. 30, 2003

(54) ELECTRONIC SWITCH FOR A BI-LEVEL FLUORESCENT LAMP FIXTURE

(75) Inventors: John Griffin, Morton Grove, IL (US); Romel Panlilio, St. Charles, IL (US); Sreeraman Venkitasubrahmanian, Naperville, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/867,261

(22) Filed: May 29, 2001

(65) Prior Publication Data

US 2002/0180378 A1 Dec. 5, 2002

(51) Int. Cl.[7] ..... G05F 1/00
(52) U.S. Cl. ..... 315/291; 315/209 R; 315/224
(58) Field of Search ..... 315/209 R, 240, 315/244, 291, 307, 311, DIG. 4, 224, 219; 323/211, 209, 241

(56) References Cited

U.S. PATENT DOCUMENTS

| | | | | |
|---|---|---|---|---|
| 5,327,048 A | * | 7/1994 | Troy | 315/240 |
| 5,546,300 A | * | 8/1996 | Lee et al. | 315/209 R |
| 5,808,423 A | | 9/1998 | Li et al. | 315/313 |
| 5,811,939 A | * | 9/1998 | Herniak | 315/313 |
| 6,031,340 A | * | 2/2000 | Brosius | 315/227 R |
| 6,191,563 B1 | * | 2/2001 | Bangerter | 315/291 |
| 6,204,614 B1 | * | 3/2001 | Erhardt | 315/291 |

* cited by examiner

*Primary Examiner*—Don Wong
*Assistant Examiner*—Jimmy T. Vu

(57) ABSTRACT

The present invention provides electronic switching for a bi-level fluorescent lamp fixture that allows power to be switched on and off to a group of lamps in a fixture when more or less illumination is needed in an area. The power can be switched without the need to power down the fixture when switching from high level with all lamps illuminated to a low level with only part of the lamps illuminated. The lamp current or frequency can be adjusted to save power when only part of the lamps are illuminated.

33 Claims, 4 Drawing Sheets

| =FILTER= | =OFFSET= | | =RECORD LENGTH= | | =TRIGGER= | |
|---|---|---|---|---|---|---|
| SMOOTHING : ON | CH1 : | 0.00V | MAIN : | 10K | MODE : | SGL(S) |
| BW : FULL | CH2 : | 1.00V | ZOOM : | 2.5K | TYPE : | EDGE CH1 |
| | CH3 : | 0.000V | | | DELAY : | 39.10us |
| | CH4 : | 0.00V | | | HOLD OFF : | MINIMUM |

ELECTRONIC SWITCH FOR A BI-LEVEL FLUORESCENT LAMP FIXTURE

TECHNICAL FIELD

The technical field of this disclosure is lighting control, particularly, electronic switching and control for a bi-level fluorescent lamp fixture.

BACKGROUND OF THE INVENTION

Bi-level switching of fluorescent lamps allows space to be illuminated as needed by providing a high level of illumination when the space is occupied and a lower level of illumination when it is not. This can be accomplished by lighting all of the fluorescent lamps for high level illumination and lighting some of the fluorescent lamps for lower level illumination. Energy use and energy cost will be reduced if lights are switched off for lower level illumination. The illumination level can be controlled manually, with timers, or with sensors able to detect when the room is occupied.

Bi-level switching of fluorescent lamps has been accomplished using a triac to switch power at the ballast output, but using a triac does not allow continuous lighting. Such switching is described in U.S. Pat. No. 5,808,423 to Li et al., assigned to the same assignee as the present invention and incorporated herein by reference. The ballast must be switched off between the high power level of the high level illumination and the low power level of the lower level illumination because the triac remains latched until power is removed completely. This is inconvenient to the occupants, since the light is switched off to switch from high to low level illumination. It is also confusing to the occupants, because the bi-level lighting is operated from a single switch. In addition, switching decreases the useful life of the lighting components, because of the input current surge when switching levels. Bi-level operation could be provided using an individual ballast for each group of fluorescent lamps, but this would be costly.

One difficulty is to maintain approximately the same light level on all the lamps during high level illumination and be able to drop the input power to 50% during low level illumination. Designs using unequal light level between lamp groups have been used, so that the lower power lamps are driven at 50% input power when the higher power lamp group is off, but the unequal brightness level provided in this approach is not commercially attractive.

It would be desirable to have electronic switching for a bi-level fluorescent lamp fixture that would overcome the above disadvantages.

SUMMARY OF THE INVENTION

One aspect of the present invention provides electronic switching for a bi-level fluorescent lamp fixture.

Another aspect of the present invention provides electronic switching for a bi-level fluorescent lamp fixture without the need to power off the ballast during switching.

Another aspect of the present invention provides electronic switching for a bi-level fluorescent lamp fixture allowing bi-level operation to reduce energy use and expense.

Another aspect of the present invention provides electronic switching for a bi-level fluorescent lamp fixture allowing bi-level operation using a single ballast per light fixture.

Another aspect of the present invention provides electronic switching for a bi-level fluorescent lamp fixture that avoids decreasing the useful life of lighting components.

Another aspect of the present invention provides approximately the same light level from all lamps during high level illumination and reduces input power during low level illumination.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

DESCRIPTION OF THE PREFERRED EMBODIMENT

The electronic switching for a bi-level fluorescent lamp fixture allows power to be switched on and off to a group of lamps in a fixture when more or less illumination is needed in an area. The power can be switched without the need to power down the fixture when switching from high level with all lamps illuminated to a low level with only part of the lamps illuminated.

Figure 1:
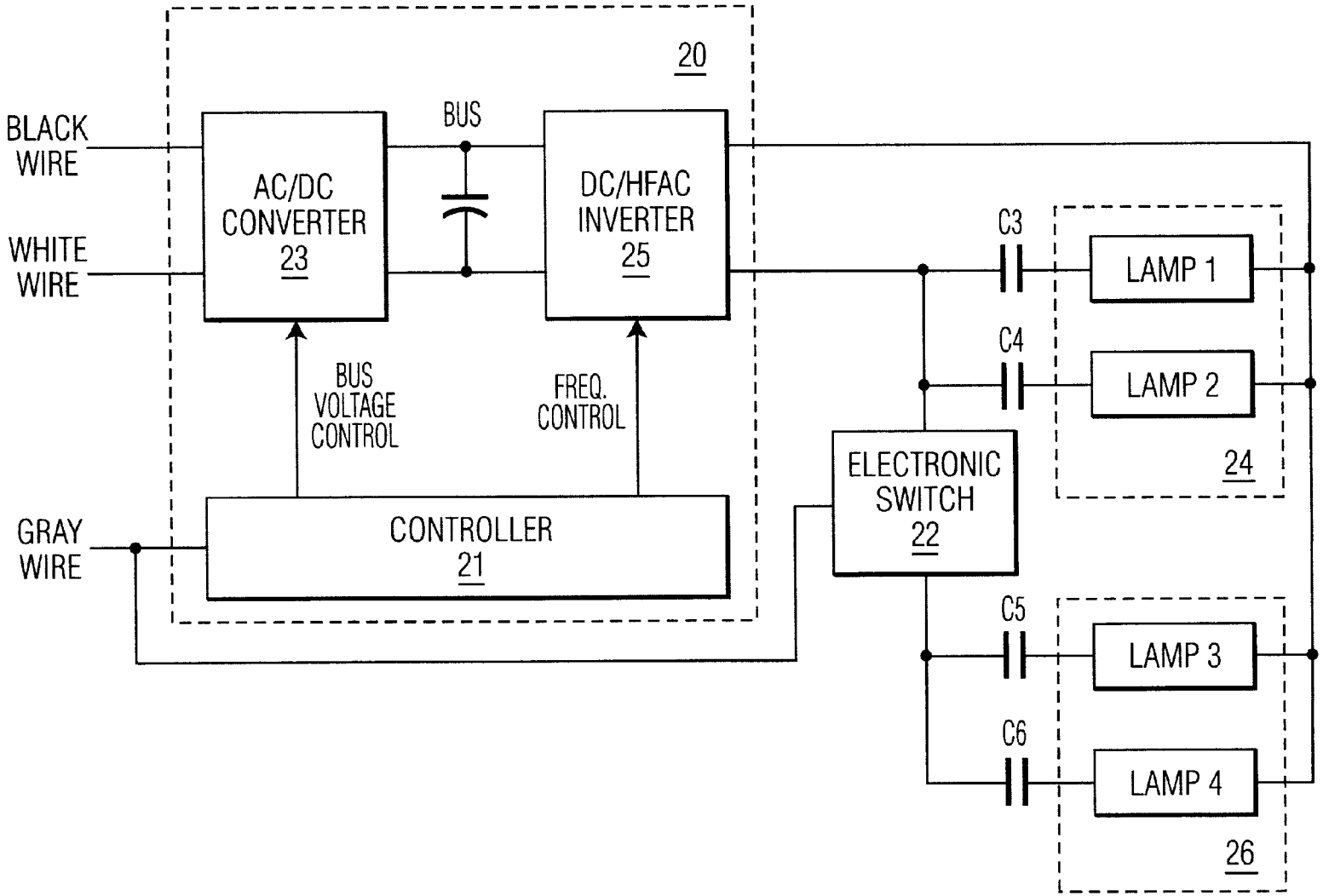
FIG. 1 shows a block diagram of a bi-level fluorescent lamp system made in accordance with the present invention.

FIG. 1 shows a block diagram of a bi-level fluorescent lamp fixture made in accordance with the present invention. Power is supplied to ballast 20 by the BLACK and GRAY wires. Power is typically supplied at 120 VAC, but can be 277 VAC or another voltage as required for a particular application. The ballast 20 can be an electronic ballast for use with fluorescent lamps. The ballast 20 supplies power to the first lamp group 24 comprising lamp 1 and lamp 2, which are connected in parallel. Second lamp group 26, comprising lamp 3 and lamp 4, are also connected in parallel to ballast 20, but connected through electronic switch 22. Electronic switch 22 controls the power to the second lamp group in response to a control signal on the GRAY wire. The control signal is typically the line voltage of 120 VAC, but can be other voltages as required for particular applications. It is well known to those skilled in the art that the control signal logic levels and voltages can vary and have reversed polarity as required for a particular application. In different embodiments, the control signal can be generated through a manual switch or through automatic control, such as automatic control that senses room occupancy or adjusts by time of day. Although the electronic switch 22 is shown separate from ballast 20, the electronic switch 22 can be included within the case of the ballast 20 for ease of installation.

Power is supplied to ballast 20 any time the lamp fixture is turned on. Ballast 20 always supplies power to the first lamp group 24, keeping it illuminated whether a high level or low level of illumination is required. When no control signal is present on the GRAY wire, the electronic switch 22 is open and power is supplied from ballast 20 to the first lamp group 24 but not the second lamp group 26. When the control signal is present on the GRAY wire, the electronic switch is closed and power is supplied from ballast 20 to the second lamp group 26, as well as the first lamp group 24. The first lamp group 24 and second lamp group 26 can each comprise a single lamp or a plurality of lamps. Typically, first lamp group 24, which is always on, will have two lamps and second lamp group 26 will have one or two lamps.

Ballast 20 can be a two-stage ballast comprising an AC/DC converter 23, DC/HFAC inverter 25, and a controller 21. The AC/DC converter 23 receives power on the BLACK and WHITE wires and provides DC power on a bus to the DC/HFAC inverter 25. The DC/HFAC inverter converts the bus DC power to a high frequency AC (HFAC) signal and supplies the HFAC power at a given current and frequency to the lamp groups through the capacitors and the electronic switch. Capacitors C3, C4, C5, and C6 are required to control current through the lamp groups because fluorescent lamps operate at approximately a constant voltage.

The GRAY wire provides the control signal to controller 21, and is the same signal provided to electronic switch 22. Controller 21 is responsive to the control signal on the GRAY wire and controls the bus voltage and the HFAC frequency, which controls the current and frequency supplied to the lamp groups from the ballast 20. Controller 21 can control either bus voltage or HFAC frequency alone, or a combination of bus voltage and HFAC frequency. If switching is performed without controller 21, the first lamp group 24 can become brighter when the second lamp group 26 is switched off, particularly for ballast types such as that of U.S. Pat. No. 5,808,423 to Li et al. For bus voltage control, controller 21 typically supplies a bus voltage control signal to the AC/DC converter 23, so that ballast 20 supplies a first lamp current when the first lamp group 24 is illuminated and the second lamp group 26 is not illuminated, and a second lamp current when the first lamp group 24 and the second lamp group 26 are both illuminated. For example, the bus voltage corresponding to the first lamp current can be 190V DC and the bus voltage corresponding to the second lamp current can be 240V DC. This method allows the input power to be reduced to a given percent, typically 50 percent, when switching from high level to low level illumination.

In another embodiment for frequency control, the controller 21 can adjust the frequency rather than the bus voltage to change the lamp illumination level when switching lamp groups. The controller 21 can supply a frequency control signal to the DC/HFAC inverter 25, so that ballast 20 supplies a first lamp frequency when the first lamp group 24 is illuminated and the second lamp group 26 is not illuminated, and a second lamp frequency when the first lamp group 24 and the second lamp group 26 are both illuminated. Frequency can be adjusted by varying the capacitance to the power transformer for self-oscillating designs such as that of U.S. Pat. No. 5,808,423 to Li et al. or by changing the driver frequency in frequency driven designs.

Figure 2:
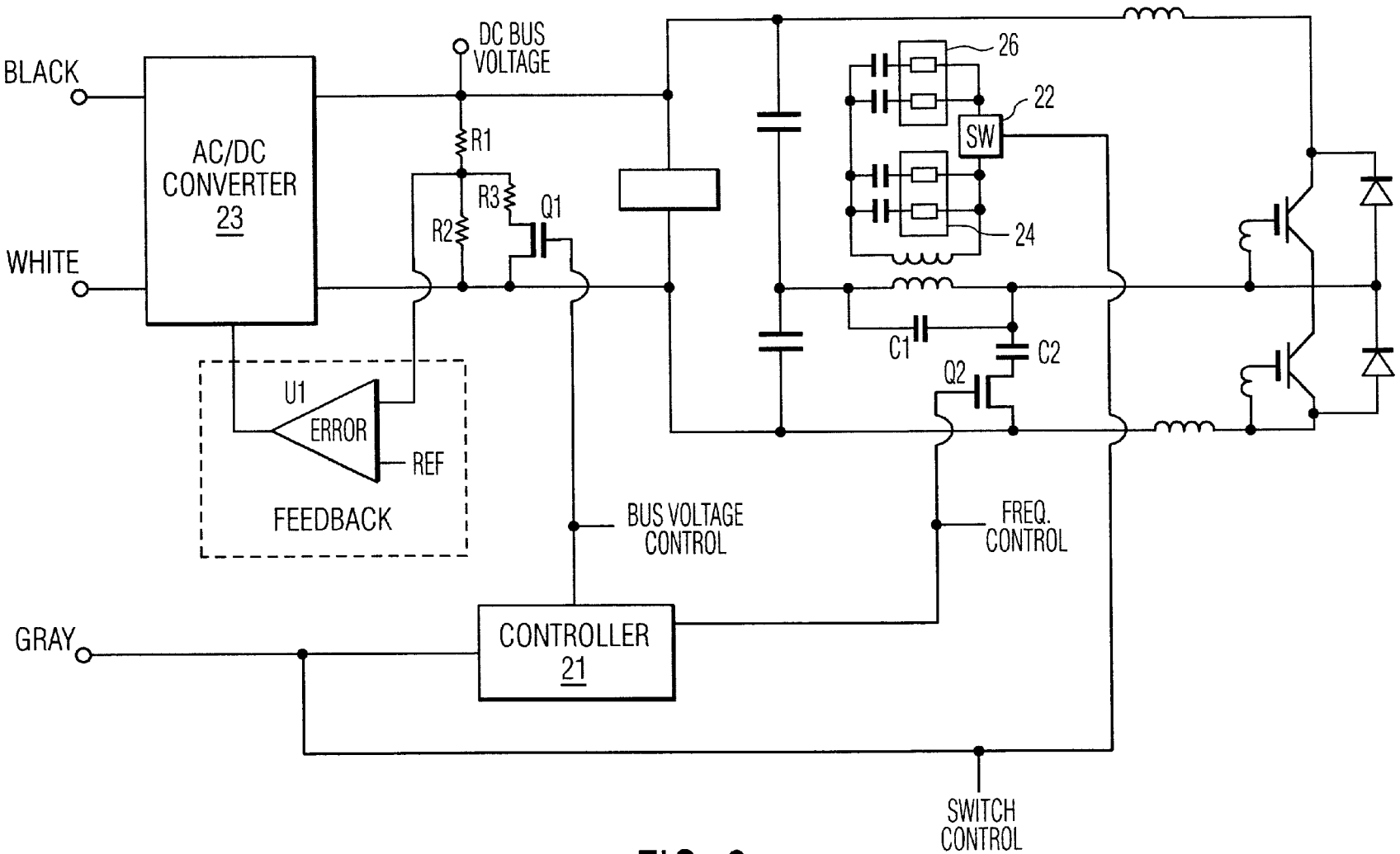
FIG. 2 shows a schematic diagram of a circuit for electronic switching for a bi-level fluorescent lamp fixture having DC bus voltage and frequency control.

FIG. 2, in which like elements share like reference characters with FIG. 1, is a schematic diagram of a circuit for electronic switching for a bi-level fluorescent lamp fixture having DC bus voltage and frequency control. The DC bus voltage output by AC/DC converter 23 is controlled by feedback control. In this embodiment, the controller 21 drives a transistor Q1 on and off to change the value of the bottom resistance for the resistor divider used for sensing the DC bus voltage. When transistor Q1 is off, the bottom resistance is R2; when transistor Q1 is on, the bottom resistance is R2 and R3 in parallel. The feedback signal through comparator U1 maintains the desired DC bus voltage by comparing the sensed DC bus voltage to a reference signal, and providing the feedback signal to the AC/DC converter 23. The controller 21 can also inject an extra current or voltage signal at an appropriate sensing point in the AC/DC converter 23 to change the DC bus voltage. In different embodiments, the DC bus voltage can be adjusted by adjusting the value of a sense (or feedback) signal or reference signal or by changing one of the component values in the feedback sensing network.

For the type of self-oscillating inverters as used in one present embodiment, the frequency of the DC/HFAC inverter 25 can be changed by changing the value of the "resonant capacitor" in response to the frequency control signal. As shown in FIG. 2, this can be done by using a transistor Q2 to switch in or out an extra capacitor C2 in parallel to an existing capacitor C1. Different types of frequency control are possible for different types of inverters. For driven inverters, there is usually an oscillator built within the IC and/or some discrete components. The frequency can be changed by sending an appropriate signal or by changing component values in the oscillator. For a VCO (voltage controlled oscillator) in the inverter, the frequency can also be changed by changing the control voltage. For an "RC" oscillator, the frequency can be changed by adjusting either an "R" or a "C" value.

Figure 3:
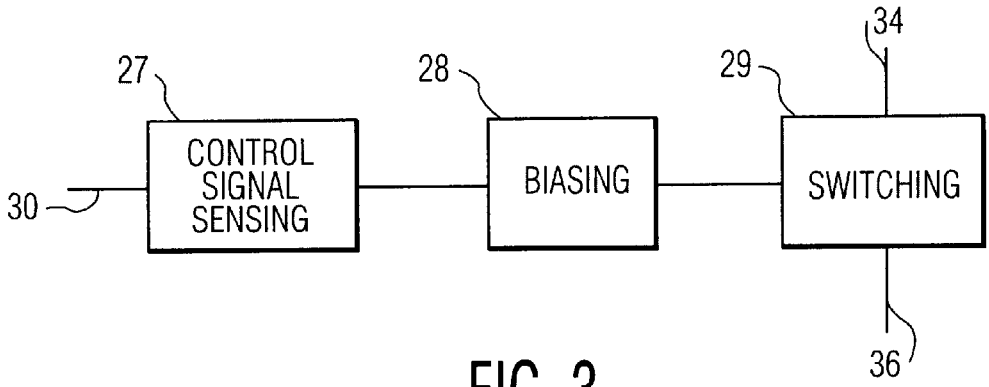
FIG. 3 shows a block diagram of a circuit for electronic switching for a bi-level fluorescent lamp fixture made in accordance with the present invention.

FIG. 3 shows a block diagram of a circuit for electronic switching for a bi-level fluorescent lamp fixture. The control signal (shown as the GRAY wire on FIG. 1) is connected to terminal 30 of the control signal sensing circuit 27. The control signal sensing circuit 27 senses the control signal and provides output to the biasing circuit 28 indicating whether the control signal is present. The biasing circuit 28 is adapted to adjust and rapidly switch the switching circuit 29. The switching circuit 29 provides an open or closed path from terminal 34 to terminal 36 in response to the biasing circuit 28 output. If the output of the control signal sensing circuit 27 is compatible with the input of the switching circuit 29, the biasing circuit 28 can be omitted.

Figure 4:
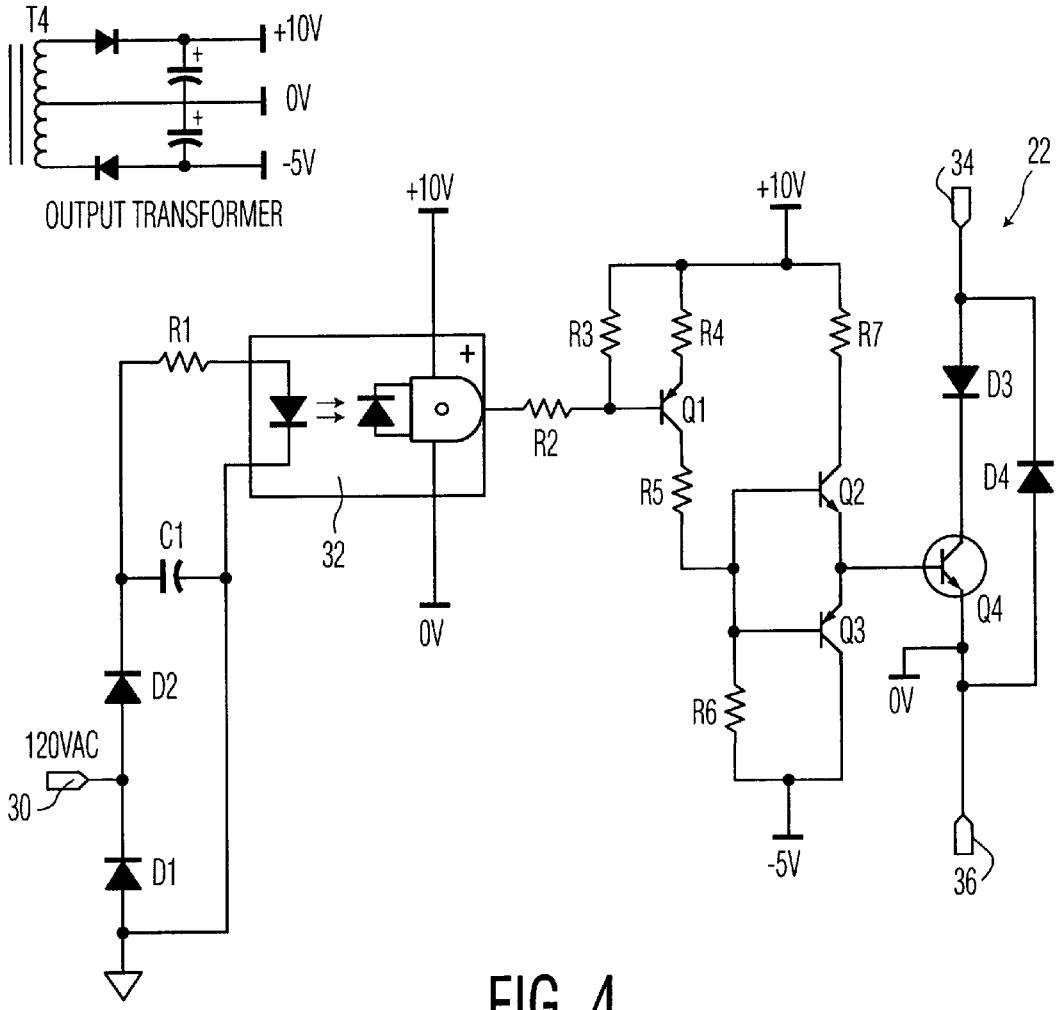
FIG. 4 shows a schematic diagram of a circuit for electronic switching for a bi-level fluorescent lamp fixture made in accordance with the present invention.

FIG. 4 shows a schematic diagram of a circuit for electronic switching for a bi-level fluorescent lamp fixture. The control signal (shown as the GRAY wire on FIG. 1) is connected to terminal 30 of the electronic switch 22. The control signal is typically the line voltage of 120 VAC, but can be other voltages as desired for particular applications. The circuit comprising diodes D1 and D2, capacitor C1, and resistor R1 rectify and filter the control signal to provide a DC input to optocoupler 32. The output of the optocoupler 32 is logic zero when the control signal is present and logic one when the control signal is not present. The optocoupler 32 can be a fast digital optocoupler using a Schmitt trigger and providing an on or off signal as an output. The optocoupler 32 isolates the electronic switch 22 from the high voltage control signal. The circuit of FIG. 4 from the input at the terminal 30 to the output of the optocoupler 32 corresponds to the control signal sensing circuit 27 of FIG. 3.

Referring to FIG. 4, with a control signal present such that the output of the optocoupler 32 is logic zero, the voltage divider of resistors R2 and R3 sources a current through the pnp transistor Q1 which in turn turns on the npn transistor Q2. This supplies a low impedance base drive to the high voltage power transistor Q4 to turn on the high voltage power transistor Q4. The circuit of FIG. 4 from the output of the optocoupler 32 to the input to high voltage power transistor Q4 corresponds to the biasing circuit 28 of FIG. 3. The high voltage power transistor Q4 can be a bipolar transistor able to handle high voltages, such as 1500 V at 0.5 Amps.

Referring to FIG. 4, with the voltage power transistor Q4 turned on, power is supplied to the switched second lamp group 26 (see FIG. 1) through terminal 34 and terminal 36. There is AC power across terminal 34 and terminal 36, so the current flows through diode D3 for one polarity and through diode D4 for the opposite polarity. The diodes D3 and D4 can be high voltage avalanche diodes. The circuit of FIG. 4 from the input to high voltage power transistor Q4 to the path through terminal 34 and terminal 36 corresponds to the switching circuit 29 of FIG. 3.

Referring to FIG. 4, to switch off the second lamp group 26 (see FIG. 1), the control signal at terminal 30 is switched off. This removes the DC input to the optocoupler 32 and the output of the optocoupler 32 switches to a logic one almost instantaneously. This immediately switches off the pnp transistor Q1, shutting off npn transistor Q2 and switching on the pnp transistor Q3. This supplies a negative voltage to the base of high voltage power transistor Q4, which gives it a fast turnoff.

Figure 5:
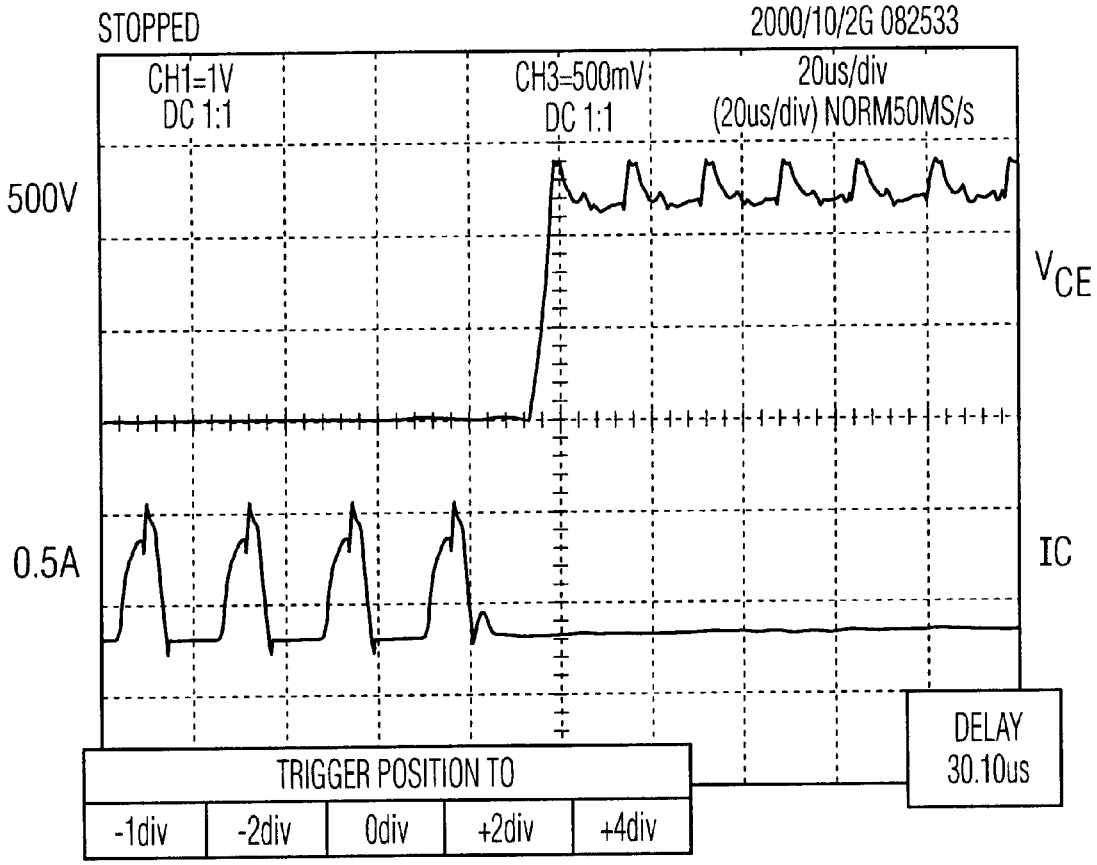
FIG. 5 shows collector emitter voltage and collector current traces for the high voltage power transistor Q4 of FIG. 4.

FIG. 5 shows a collector emitter voltage and collector current trace for the high voltage power transistor of FIG. 4. If high voltage power transistor Q4 turns off too slowly, the collector emitter junction of the high voltage power transistor Q4 will degrade and fail after a number of switching cycles. The collector emitter junction can start to leak so that the second lamp group 26 is always on and cannot be turned off. Faster switching helps avoid the problem region. Degradation can be seen above switching times of 100 μseconds, while a typical switching time can be 50 μseconds or faster. FIG. 5 shows a switching time of 8 μseconds, which approaches the physics limits of a high voltage power transistor.

It is important to note that FIGS. 1–5 illustrate specific applications and embodiments of the present invention, and are not intended the limit the scope of the present disclosure or claims to that which is presented therein. Upon reading the specification and reviewing the drawings hereof, it will become immediately obvious to those skilled in the art that myriad other embodiments of the present invention are possible, and that such embodiments are contemplated and fall within the scope of the presently claimed invention.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A circuit for electronic switching for a bi-level fluorescent lamp fixture, the bi-level fluorescent lamp fixture having a first lamp group and a second lamp group, the first lamp group and the second lamp group powered from a ballast at a lamp current and a lamp frequency, comprising:

a control signal sensor responsive to a control signal and providing a control signal sensor output; and a switching circuit responsive to the control signal sensor output;

wherein the second lamp group is being switched by the switching circuit without switching off the first lamp group.

2. The circuit of claim 1 wherein the control signal is at line voltage.

3. The circuit of claim 1 wherein the control signal sensor further comprises a filter and rectifier for conditioning the control signal, and an optocoupler responsive to the conditioned control signal.

4. The circuit of claim 3 wherein the optocoupler is a digital optocoupler using a Schmitt trigger.

5. The circuit of claim 1 wherein the switching circuit further comprises a first diode in series with a transistor, the transistor having a transistor switching time, and a second opposite diode connected in parallel to the series.

6. The circuit of claim 5 wherein the transistor is a high voltage power transistor.

7. The circuit of claim 5 wherein the transistor switching time is selected from the group consisting of 0 μseconds to 100 μseconds, 0 μseconds to 50 μseconds, and 0 μseconds to 10 μseconds.

8. The circuit of claim 5 wherein the first diode and the second opposite diode are avalanche diodes.

9. The circuit of claim 1 wherein the ballast is responsive to the control signal, the ballast providing a first lamp current when the first lamp group is on and the second lamp group is off, and a second lamp current when the first lamp group is on and the second lamp group is on.

10. The circuit of claim 1 wherein the ballast is responsive to the control signal, the ballast providing a first lamp frequency when the first lamp group is on and the second lamp group is off, and a second lamp frequency when the first lamp group is on and the second lamp group is on.

11. The circuit of claim 1, the ballast further comprising:

a controller responsive to the control signal, the controller providing a bus voltage control signal;

an AC/DC converter supplying a bus voltage, the AC/DC converter being responsive to the bus voltage control signal; and a DC/HFAC inverter receiving the bus voltage, the DC/HFAC inverter supplying the lamp current and the lamp frequency.

12. The circuit of claim 1, the ballast further comprising:

a controller responsive to the control signal, the controller providing a frequency control signal;

an AC/DC converter supplying a bus voltage; and a DC/HFAC inverter receiving the bus voltage, the DC/HFAC inverter being responsive to the frequency control signal, the DC/HFAC inverter supplying the lamp current and the lamp frequency.

13. A system for electronic switching for a bi-level fluorescent lamp fixture, the bi-level fluorescent lamp fixture having a first lamp group and a second lamp group, the first lamp group and the second lamp group powered from a ballast at a lamp current and a lamp frequency, comprising:

means for sensing a control signal, the control signal sensing means providing a control signal sensor output;

means for biasing electrically connected to the control signal sensing means, the biasing means being responsive to the control signal sensor output and providing a biased output, and means for switching electrically connected to the biasing means, the switching means being responsive to the control signal sensor output;

wherein the second lamp group is being switched by the switching means without switching off the first lamp group.

14. The system of claim 13 wherein the control signal sensing means further comprises means for filtering and rectifying the control signal, and an optocoupler responsive to the filtered and rectified control signal.

15. The system of claim 13 wherein the biased output is a positive voltage when the control signal is on and a negative voltage when the control signal is off.

16. The system of claim 13 wherein the switching means further comprises a first diode in series with a transistor, the transistor having a transistor switching time, and a second opposite diode connected in parallel to the series.

17. The system of claim 13 further comprising means for controlling the lamp current, the current controlling means being responsive to the control signal.

18. The system of claim 13 further comprising means for controlling the lamp frequency, the frequency controlling means being responsive to the control signal.

19. The system of claim 13 further comprising:

means for converting an AC signal to a DC signal;

means for controlling the AC to DC converting means, the controlling means being responsive to the control signal; and means for inverting the DC signal to an HFAC signal, the DC to HFAC inverting means supplying the lamp current and the lamp frequency.

20. The system of claim 13 further comprising:

means for converting an AC signal to a DC signal;

means for inverting the DC signal to an HFAC signal, the DC to HFAC inverting means supplying the lamp current and the lamp frequency; and means for controlling the DC to HFAC inverting means, the controlling means being responsive to the control signal.

21. A method of electronic switching for a bi-level fluorescent lamp fixture, the bi-level fluorescent lamp fixture having a first lamp group and a second lamp group, the first lamp group and the second lamp group powered from a ballast at a lamp current and a lamp frequency, comprising the steps of:

sensing a control signal and providing a control signal sensor output;

biasing the control signal sensor output and providing a biased output, and switching the second lamp group in response to the biased output within a switching time without switching off the first lamp group.

22. The method of claim 21 wherein the control signal is at line voltage.

23. The method of claim 21 wherein the step of sensing a control signal and providing a control signal sensor output further comprises filtering and rectifying the control signal, and generating the control signal sensor output from the filtered and rectified control signal using an optocoupler.

24. The method of claim 23 wherein the optocoupler is a digital optocoupler using a Schmitt trigger.

25. The method of claim 21 wherein the biased output is one polarity when the control signal is on and the opposite polarity when the control signal is off.

26. The method of claim 21 wherein the step of switching the second lamp group in response to the biased output further comprises switching a transistor, the transistor having a transistor switching time.

27. The method of claim 26 wherein the transistor is a high voltage power transistor.

28. The method of claim 26 wherein the transistor switching time is selected from the group consisting of 0 $\mu$seconds to 100 $\mu$seconds, 0 $\mu$seconds to 50 $\mu$seconds, and 0 $\mu$seconds to 10 $\mu$seconds.

29. The method of claim 21 further comprising the step of adjusting lamp current in response to the control signal.

30. The method of claim 21 further comprising the step of adjusting lamp frequency in response to the control signal.

31. The method of claim 21 further comprising the steps of:

converting an AC signal to a DC signal, the DC signal voltage depending on the control signal; and inverting the DC signal to an HFAC signal supplying the lamp current and the lamp frequency.

32. The method of claim 21 further comprising the steps of:

converting an AC signal to a DC signal; and inverting the DC signal to an HFAC signal supplying the lamp current and the lamp frequency, the HFAC signal frequency depending on the control signal.

33. The method of claim 21 further comprising the steps of:

converting an AC signal to a DC signal, the DC signal voltage depending on the control signal; and inverting the DC signal to an HFAC signal supplying the lamp current and the lamp frequency, the HFAC signal frequency depending on the control signal.

* * * * *